US007707758B2

(12) United States Patent
Stagg

(10) Patent No.: US 7,707,758 B2
(45) Date of Patent: May 4, 2010

(54) COMPOSITE MAGNETIC ADVERTISING MAILING CARDS

(75) Inventor: Malcolm J. Stagg, Oakville (CA)

(73) Assignee: SnapNwin Inc., Oakville, Ontario (CA)

( * ) Notice: Subject to any disclaimer, the term of this patent is extended or adjusted under 35 U.S.C. 154(b) by 112 days.

(21) Appl. No.: 11/707,998

(22) Filed: Feb. 20, 2007

(65) Prior Publication Data

US 2008/0196284 A1 Aug. 21, 2008

(51) Int. Cl.
*G09F 7/04* (2006.01)

(52) U.S. Cl. ..... 40/600; 229/92.8

(58) Field of Classification Search ..... 40/124.01, 40/124.04, 124.191, 600, 630, 661.02, 675
See application file for complete search history.

(56) References Cited

U.S. PATENT DOCUMENTS

| | | | | |
|---|---|---|---|---|
| 4,887,763 | A | 12/1989 | Sano | |
| 5,458,282 | A | 10/1995 | Martin | |
| 5,571,999 | A | 11/1996 | Harris | |
| 5,676,307 | A | 10/1997 | Martin | |
| 5,705,243 | A | 1/1998 | Mehta | |
| 5,865,470 | A | 2/1999 | Thompson | |
| 5,868,498 | A | 2/1999 | Martin | |
| 5,949,050 | A | 9/1999 | Fosbenner et al. | |
| 5,992,731 | A | 11/1999 | Tani | |
| 6,024,278 | A | 2/2000 | Martin | |
| 6,153,280 | A | 11/2000 | Uffmann | |
| 6,481,125 | B1 * | 11/2002 | Pokrasoff | 40/124.01 |
| 6,718,673 | B2 | 4/2004 | Ray, III | |
| 6,743,493 | B2 | 6/2004 | Crum et al. | |
| 6,824,135 | B2 * | 11/2004 | Stancik | 273/139 |
| 6,890,183 | B2 * | 5/2005 | Baker | 434/430 |
| 6,982,114 | B2 * | 1/2006 | Crum | 428/192 |
| 6,984,083 | B2 | 1/2006 | Crum | |
| 7,055,862 | B2 * | 6/2006 | Viby | 283/81 |
| 7,063,258 | B1 | 6/2006 | Karolewicz | |
| 7,128,798 | B2 | 10/2006 | Boudouris | |
| 7,225,568 | B1 * | 6/2007 | Rizzo et al. | 40/600 |
| 2002/0047263 | A1 * | 4/2002 | McCarthy et al. | 283/107 |

(Continued)

FOREIGN PATENT DOCUMENTS

| | | |
|---|---|---|
| CA | 2375622 | 9/2002 |

(Continued)

*Primary Examiner*—Joanne Silbermann
(74) *Attorney, Agent, or Firm*—Manelli Denison & Selter PLLC; Edward J. Stemberger

(57) ABSTRACT

A composite magnetic card for bearing printed data and suitable for mailing purposes comprising (a) a first planar sheet of paper cardstock having a first face and second face;

(b) a second planar sheet comprising a magnetic material having a first face and a second face and defining at least one detachable portion defined by a die cut while having suitably located portions integrally retained to non-detachable magnetic material of the second planar sheet;

wherein the first sheet first face is sufficiently and suitably adhered with an adhesive to the second sheet first face to retain the detachable portion of the second sheet to the first sheet but wherein the adhesive is not disposed at first selected locations between the first sheet and the second sheet within the card. The resultant card after the detachable portion has been removed is adhesive-free to provide a non-sticky, clear area of the card, which may be readily used to clearly displace further desired data.

14 Claims, 5 Drawing Sheets

U.S. PATENT DOCUMENTS

| | | | |
|---|---|---|---|
| 2002/0130511 | A1 | 9/2002 | Thompson et al. |
| 2003/0049403 | A1 | 3/2003 | Crum et al. |
| 2003/0049404 | A1 | 3/2003 | Mercer et al. |
| 2003/0077465 | A1 | 4/2003 | Boudouris |
| 2003/0165652 | A1 | 9/2003 | Rivera |
| 2004/0166275 | A1 | 8/2004 | Martin |
| 2004/0247366 | A1 | 12/2004 | Crum |
| 2006/0151340 | A1 | 7/2006 | Meister |
| 2006/0266809 | A1 | 11/2006 | Wert |

FOREIGN PATENT DOCUMENTS

| | | |
|---|---|---|
| CA | 2351142 | 12/2002 |
| CA | 2466475 | 6/2003 |

* cited by examiner

COMPOSITE MAGNETIC ADVERTISING MAILING CARDS

FIELD OF THE INVENTION

This invention relates to composite cards comprising a magnetic sheet and paper cardstock bearing advertising designations for direct and addressed postal service mailing and other means for distribution; more particularly to said cards having detachable portions; and to processes of manufacturing said cards.

BACKGROUND OF THE INVENTION

Flexible magnetic sheeting has been in use for a number of years to produce advertising specialty items commonly referred to as "refrigerator magnets". These are used in both home and business environments and provide a long-lasting, effective, advertising medium when stuck to a metal surface, such as a refrigerator door, school locker, a filing cabinet and the like.

Traditionally, the magnetic sheeting has been manufactured as a thin, calendared sheet of rubber or other polymers containing strontium ferrite powder. The magnetization has normally been accomplished at the time of manufacture and consists of imparting a multi-pole array to provide a coercive (magnetic) force primarily to one side of the sheet. This magnetic material is sold in rolls or master sheets to advertising specialty converters who print them with an advertising message and then die cut into shapes for the advertiser. Printing was originally done by silk screening onto a vinyl surfaced sheet bonded to the magnetic polymer material. A subsequent process that became more popular was offset process printing onto a separate paper sheet and bonding the printed paper sheet to the magnetic sheet. This has been replaced to a large extent now by inkjet and digital printing due to the superior economy of digital printing for shorter production runs and the high quality now associated with digital printing. The printed paper has often been laminated with a clear thin polymer film for appearance and smudge resistance prior to bonding to the magnetic sheet. The traditional thickness of flexible magnetic sheeting is 0.3 mm to 0.75 mm thick. Typically these are produced on production lines 60 cm wide by the magnet manufacturer, and cut into master (press sheets) of 30 cm by 48 cm or larger for printing and bonding. The final bonded sheet is then die cut, into many smaller pieces from a size of 5 cm ×5 cm upwards, in conventional or decorative shapes.

One of the goals of the advertiser is to minimize the cost to have these magnets made, printed and delivered to the end-user. To minimize the cost of delivery, direct mail has been a desired choice, with automated "machinable" mail which can be scanned with automatic bar code reading equipment being the lowest cost. In addition, avoiding multiple steps in production, or complex or manual fabrication keeps costs lower. The simplest mail piece configuration, a postcard avoids the labour and material costs to fold, stuff, and seal and address envelopes and may qualify for lower mass mailing rates.

Another goal is to maximize the probability of the end user reading, and being motivated to keep the magnetic advertising piece, in that way increasing the probability of a purchase or use of the advertising or message, and a higher return on the advertising investment. Increasingly this involves being able to personalize the message to make it relevant to the end-user. With digital printing, unlike offset process or silk screening, it is feasible to have each mail piece unique in its content and images. Databases with information on demographics, past purchasing habits, household income, or such details as presence/absence of children or pets are widely utilized by advertisers. They are incorporated into variable data software in the digital printing process. In addition advertisers can direct end-users to personalized website addresses to enter contests or purchase services.

To obtain problem-free personalization it is advantageous not to have multiple pieces to assemble and in the case of magnets, to avoid trying to sort the die cut magnet pieces to match up the names with an envelope or insert.

With the above factors and the significant weight of the magnet, and the postal sorting problems of the inherent coercive force it has been difficult to achieve low cost mailings with magnets that were effective advertising mediums.

One example of an attempt to overcome these issues is provided in U.S. Pat. No. 5,458, 282, issued Oct. 17, 1995 to Crane Productions Inc. Here a magnetic sheet is bonded to one end of a postcard, which is perforated to allow the magnetic portion to be removed. The limitation with the teaching of this example of prior art is that it leaves a magnet force facing outward, potentially jamming sortation equipment, the rough perforated edge to the magnet, the dual thickness affecting stacking of the finished product, and the loss of advertising space taken up by the face of the plain brown magnetic sheet.

An improvement on this prior art by the same inventor, Martin, in U.S. Pat. No. 5,676,307, issued Oct. 14, 1997 to Crane Productions Inc., provides for a tape to be applied to the back of the postcard along the edge of the magnet sheet. This "ramp" is claimed to reduce mailing problems by making the stacking of the cards easier by reducing the sharp "bump" at the edge of the magnetic sheet adhered to the postcard which made the machine stacking of the postcard problematic.

In another patent by Martin, U.S. Pat. No. 6,024,278, issued Feb. 15, 2000 to Crane Productions, Inc. a mailable envelope containing coupons is described. In this prior art a cardstock envelope is constructed with a magnetic sheet on the front, said sheet having a printed face containing postal indicia and address information. In this envelope, coupons are placed with the magnetic sheet holding it to the metal surface. The limitation of this prior art is the cost of assembling a complex multiple part piece and the mailing weight involved.

In U.S. Pat. No. 6,153,280, issued Nov. 28, 2000 to Magnet, LLC, discloses the use of a magnetic strip applied to the back of a postcard, which is internally perforated to allow a portion of the magnetic backed portion to be removed. This has the continuing problem of not being automated mail compatible, and has the same issue as the aforesaid prior art with the unattractive brown magnetic face taking up a significant portion of one side of the card.

U.S. Pat. No. 6,986,953, issued Jan. 17, 2006 to Ward/Kraft Inc., describes a one-side only printed magnetic sheet consisting of a printable paper surface, bonded to a pre-magnetized magnetic sheet layer which is bonded with a frangible adhesive across its complete surface to a non-printed release layer. This sheet is printed with souvenir photos or other remembrances on the removable portions. The resultant sheet after the detachable elements have been removed, retains adhesive residue resulting from the frangible coating, which may be sticky.

To seek another method, U.S. Pat. No. 7,063,258, issued Jun. 20, 2006 to Dan Karolewicz, provides for a small annular magnetic shape glued to the back of a card to provide it with the ability to hold itself to a metal surface. This non-planar combination is placed in an envelope for bulk mailing. This prior art has the limitation of rendering the card non-planar like the two earlier instances noted above, and requiring an envelope for mailing.

In common commercial use today, magnetic postcard mailers are marketed with a conventional cardstock postcard on which a printed magnetic shape has been placed and then held in place with an overlying clear laminate film. The magnet is released by using a sharp point or by bursting through a perforated line in the film around the magnet. Due to the loose nature of the printed magnets being dropped onto the cardstock, the magnet generally must be a generic non-personalized one. This method limits the personalization possible, and requires multiple processes to manufacture cards and magnets separately and then bond the two together.

Also in commercial use by advertisers, is the practice of creating a generic or personalized magnet in the shape of a credit card and then placing this with a removable adhesive securing it onto a folded letter, or card or pamphlet, which is then placed into an addressed window or plain envelope. This magnetic shape may be constructed of a thin magnetic paper laminate to minimize weight. However this still entails the costly issue of being able to match separately produced magnets with a personalized ad or letter and the fact that the removable advertisement piece, the magnet, is hidden inside an envelope, reducing the odds of its use as a refrigerator magnet.

Given the limitations of the prior art, there still remains a need for a more cost-effective and innovative way of creating a magnetic card suitable for mass mailing. More specifically, this innovation should, ideally, overcome most, if not all of the limitations of the prior art by:

(a) being able to be mailed without requiring its insertion into an envelope;

(b) when used as a mail postcard it has a low enough coercive field such that it can be processed by automated sorting equipment securing the lowest postal rates;

(c) being of a single, uniform and thin enough thickness to enable sorting and stacking without jamming up in machine fed sorting and stacking operations;

(d) being designed so that none of the areas of the piece as received are "dead space" consisting of the unprinted side of the magnet;

(e) being capable of printing so that both the retained magnetic piece and both sides of the card can be fully variable, if desired, enabling full personalization of the advertising piece;

(f) the card and the magnetic piece being manufactured in a single process so that it is not necessary to die cut magnets, strip them from their master sheet and then attach them to the card;

(g) designed so that the magnets may be directly printed in a (digital, inkjet or offset) printing press on a printable surface, avoiding the necessity of printing a sheet of paper and then bonding the printed paper to the magnetic sheeting;

(h) designed so that the coercive forces can be adjusted in the magnetic sheet so that a higher force may be used if the card is handed out and a lower one if the card is processed by a postal service with stringent specifications or more magnet sensitive processing equipment; and (i) designed so that the coercive force can be imparted to a higher or lesser degree in selected portions of the sheet. In this way the non-removable portion may have less magnetic force, further facilitating the use of the card in postal machine sorting operations.

(j) designed so that the end user immediately views the removable magnetic piece of lasting advertising value, and sees a message providing an incentive to remove it to reveal a hidden offer, prize or message.

A magnetic card product with most or all of these advancements would offer significant advantages and overcome the limitations of the prior art as described above.

SUMMARY OF THE INVENTION

The present invention offers a new and superior way to produce magnetic cards primarily intended for, but not limited to advertising mailings.

In its simplest form, the card contains a flat flexible magnet detachable from a paper cardstock. In some embodiments, preferably, the card is laminated with polymer on both sides, which protects the magnet, enhances the graphic image and enhances safe postal delivery.

Surprisingly, I have discovered that it is possible to not require an adhesive-frangible or otherwise between the removable magnetic portion and the remainder of the card. I have found that if the magnetic layer is die cut to the desired shape for the shaped detachable portion but leaving non-cut suitably located intermittent portions integral with the magnetic material to be retained to the card, that avoidance of use of an adhesive can be achieved. Non-use of an adhesive results in the card after the desired detachable portion has been detached in the newly visible region not being sticky by residual adhesive and, most preferably, having a clear surface viewable by a recipient to better see any data or design present thereon.

Accordingly, in one aspect, the invention provides a composite magnetic card for bearing printed data and suitable for mailing purposes comprising (a) a first planar sheet of paper cardstock having a first face and second face;

(b) a second planar sheet comprising a magnetic material having a first face and a second face and defining at least one detachable portion defined by a die cut while having suitably located portions integrally retained to non-detachable magnetic material of said second planar sheet;

wherein said first sheet first face is sufficiently and suitably adhered with an adhesive to said second sheet first face to retain said detachable portion of said second sheet to said first sheet but wherein said adhesive is not disposed at first selected locations between said first sheet and said second sheet within said card.

The cards may bear printed data or designations on the first or second or on both faces of the first sheet either directly thereon or on or under the outer polymer surface of a polymer/cardstock laminate.

Similarly, the second sheet comprising the magnetic material may bear printed data or designations on its second surface directly or on or under the outer polymer surface of a polymer/magnetic material laminate.

Thus, in this aspect, the invention consists of a multi-layer composite card with printable surfaces, optionally, on both sides, and having on one side a magnetic portion defining a desired shape removable from the card.

The first layer of the composite card is a printed paper cardstock bonded to the middle layer by means of an adhesive applied solely in the areas outside the magnet cutout. The middle layer is a magnetic sheet, magnetized with its multipole pattern of magnetic force on its face adjacent to the first layer. The magnetic layer is bonded to the third layer with a permanent adhesive over its complete surface. The third layer is printed and may be constructed from any suitable material, including but not limited to paper and plastic sheets. Alternatively this layer may not be a separate sheet adhesively bonded to the magnetic layer but a liquid applied polymer coating which is receptive to printed images and text.

A die cut may be made that extends through the third layer and through the magnetic layer, but not through or substantially into the first layer. The die cut when made, is controlled in depth and by use of strategically located non-cut parts, the magnetic piece is retained until it is removed by the end-user.

The magnetizing of the magnetic layer may be done at the time of its manufacture or in a preferred embodiment of this invention; it may be magnetized during the construction of the finished product. By magnetizing a part of the printing and die cutting process, the degree of magnetization may be chosen and a variation in that degree created to minimize the magnetic force of the completed card by having none or reduced magnetization in the non-removable area.

The die cut shape in the interior portion of the card and may be of any regular geometric or fanciful shape. The card so described may contain one or a multiple number of such shapes.

The card as described above is preferably cut from two similar sized printed master sheets (press sheets), which may contain space for many cards. This press sheet is preferably printed on a digital press thus allowing the front and back faces to be printed in alternate fashion, and also allowing the inclusion of variable data and ease of matching the front and back sides to be bonded together.

In another alternate embodiment the first layer of cardstock is printed on both sides, yielding a message to the end-user, when the magnetic portion is removed.

In a further aspect the invention provides a process a process of making a composite magnetic card comprising (a) feeding (i) a sheet of first material having a first printable face and a second face and comprising paper cardstock; and (ii) a sheet of a second material having a first printable face and a second face and comprising a magnetic material, to a digital press;

(b) printing desired designations on said first material first printable face and on said second material first printable face by said press;

(c) registering said sheet of first material with said sheet of second material in juxtaposition with each of said second faces facing each other;

(d) selectively applying an adhesive to effect adhesive bonding of said sheet of first material to said sheet of second material at said second faces to produce said composite magnetic card, but not at first selected locations between said first sheet and said second sheet within said card.

The term "advertisers" as used in this specification takes its usual commercial meaning, but its meaning is not limited to private enterprises seeking to encourage business such as retailers, restaurants, real estate companies, manufacturers or distributors, as examples. The term may also apply to any level of government or other public sector or non-profit organizations, such as social services organizations, city governments, schools, institutions, sports teams, charitable foundations, cultural or religious organization as examples.

The card and/or its removable magnetic piece, if included, may be of any imaginative shape and size that fulfills the needs of the advertiser, and acceptable as a postcard if mailed. This may be rectangular, for example, in the shape of common objects, such as a house or automobile, or a fanciful shape.

BRIEF DESCRIPTION OF THE DRAWINGS

In order that the invention may be better understood, preferred embodiments will now be described, by way of example only, with reference to the accompanying drawings wherein.

and wherein the same numerals denote like parts.

DETAILED DESCRIPTION OF PREFERRED EMBODIMENTS

Thus, the invention provides a new and advantageous advertising card which is suitable for mass mailing to end-users. It is to be understood that the description terminology does not limit the uses of the invention.

Figure 1:
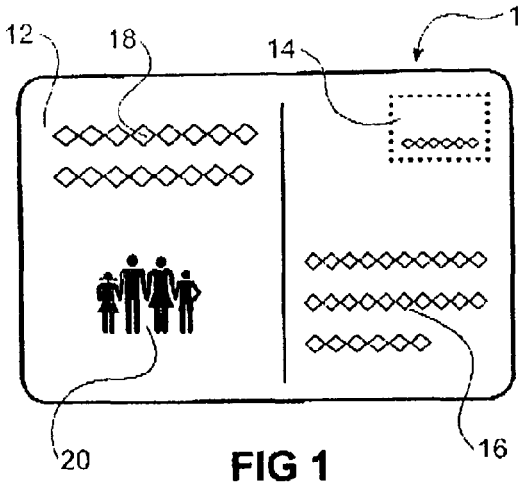
FIG. 1 is a diagrammatic front view showing the front address side of a postcard according to the invention.
Figure 2:
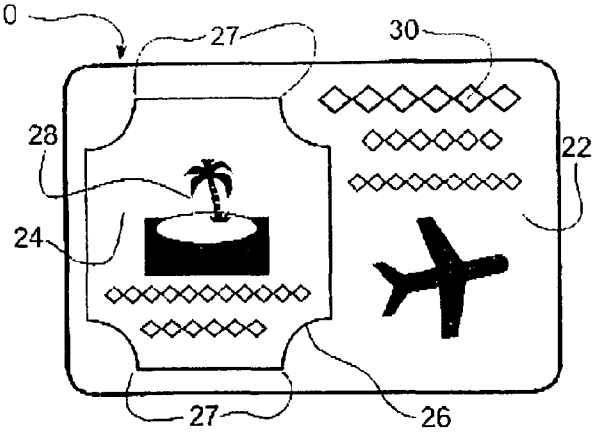
FIG. 2 is a diagrammatic view showing the back advertising side of the postcard of FIG. 1 with a removable magnet die cut out.

With reference to the drawings in more detail, FIGS. 1 and 2 illustrate the front and back sides, respectively, of a typical use of the invention as a postcard shown generally as 10. Card 10 may be of any shape but is rectangular in the embodiment shown, and has an address face 12 as shown in FIG. 1. Card 10 is partly composed of a planar cardstock 11 (FIG. 3) which may be of any printable material, such as coated or uncoated paper, plastic or a combination of suitable materials. On face 12 of this material 11, conventional postal indicia or stamp 14 and address 16 are placed as well as a variable or an unchanging static text message 18 and a variable image 20 or an unchanging status, if so desired.

The reverse side of card 10, as shown in FIG. 2, has a face 22 of a planar, printable coated paper. Alternative materials, such as, uncoated paper, cardstock, plastic, metallized plastic, printable liquid-applied coatings or a combination of suitable materials may also be used. Face 22 has an area of a removable magnetic portion 24 as delineated by die cut line 26 of any desired practical shape.

There is no die cut at suitable locations 27, for example, which enables detachable portion 24 to remain integrally formed with the non-detachable magnetic material adhered to sheet 11, until facile removal is desired by recipient.

Thus, the uncovered surface of sheet 11 has no adhesive residue and is clear for satisfactory viewing.

As shown in FIG. 2, on card 10 there may be printed a plurality of text/images, either static or variable. These may be on the removable magnetic area portion 24, shown as 28, and/or as shown as 30 in the non-removable card area.

Figure 3:
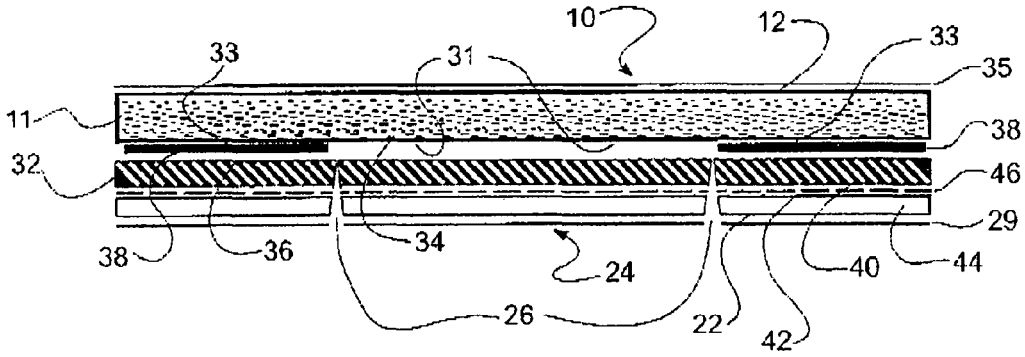
FIG. 3 is a diagrammatic cross sectional view across the thickness of the postcard with the orientation of FIG. 1.

FIG. 3 shows a cross-sectional thickness view of card 10 in the orientation of FIG. 1 wherein the thickness has been exaggerated to better show the components clearly. Cardstock 11 material is preferably of a thickness of 0.2 mm to 0.4 mm inches to provide sufficient stiffness and to provide a distance, i.e. space or gap between the coercive forces of magnetic layer 32 and any metallic mail sorting machinery or other metallic or magnetic surfaces encountered during any subsequent processing, mailing and delivery of card 10. A clear polymer layer 35 is, in this embodiment, optionally, laminated to layer 11.

Figure 11:
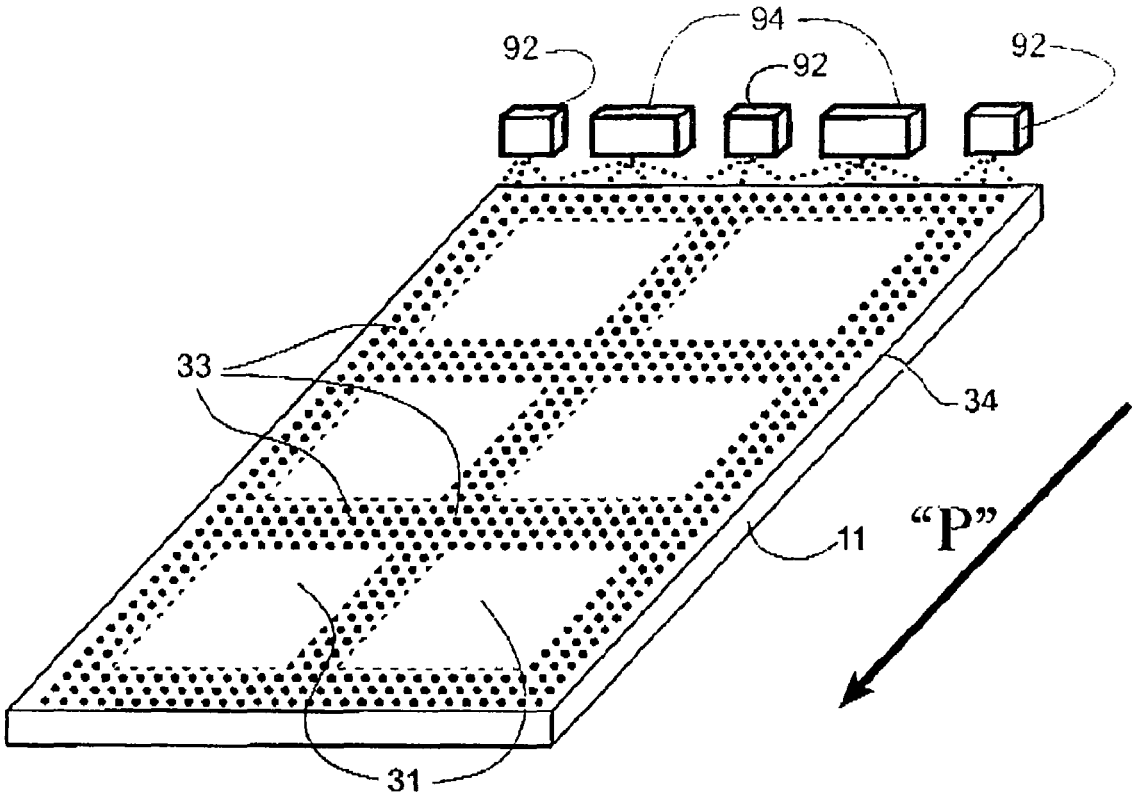
FIG. 11 represents the preferred method of applying adhesive by doing so in selected areas only.

Second face 34 of cardstock sheet 11 is bonded to first face 36 of magnetic layer 32 with a layer of adhesive 38 over selected locations only. This adhesive layer may be of any suitable adhesive e.g. a water based EVA (ethylene-vinyl acetate), acrylic or a heat-activated hot melt polymer. The permanent non-removable adhesive is applied to those selected portions 33 of sheet 11 where magnetic material 32 is not to be detached from card 10 as shown in FIG. 11, to leave portions 31 adhesive free.

Magnetic layer 32 consists of a calendared rubber or other flexible polymer material 32 having ferrite additives, which can be readily magnetized. Sheet 32 is preferably of a thickness of 0.15 mm to 0.3 mm and is commercially available. In the practise of the invention, it is preferably utilized in a non-magnetized form which facilitates its processing through printing presses containing steel rollers, trays and guides, in the size of the master sheet for print imaging or as a roll, bonded on its whole surface at face 40 to an inner face 42 of paper card stock 44 by adhesive 46.

Adhesive 46 may be applied by the magnetic sheet manufacturer or applied by the advertising specialty or printing converter. The adhesive is most preferably of a permanent nature providing a contiguous bond between the two layers.

Material 44 is composed of any suitable material which most commonly would be paper, cardstock, synthetic paper, plastic film, a liquid applied printable polymer layer, or a metallic plastic film and having a suitable printable surface 22. The thickness and weight of this layer will preferably be the minimum needed to provide sufficient opacity and print quality. In the case of paper stock this minimum would be in the order of a 50 lb. (75 gm/sq·m) paper stock. A clear polymer layer 29 is, in this embodiment, optionally, laminated to layer 44. Cuts 26 are imparted by die cutting, the sharp steel rules of which cut through layers 44, 46 and 32 but not 11. Short gaps in the steel rule at selected locations as shown as 27 in FIG. 2 do not cut layers 44, 46 and 32 or cut at a lesser depth. In this way, removable magnetic piece 24 is temporarily retained but easily detached from cardstock sheet 11 by bending card 10 to a small degree.

Figure 4:
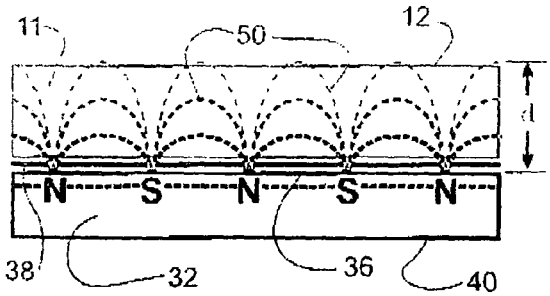
FIGS. 4 and 5 represent magnetization patterns through the card thickness in part.

In FIG. 4 the multi-pole magnetization pattern of magnetic layer 32 is shown with the poles North and South represented by the letters N and S respectively. This magnetization is imparted to sheet 32 prior to bonding to layer 11 in a commercial magnetizing machine. Sheet 32 passes over magnetizing rollers with its face 36 adjacent to the rollers to impart a multi-pole array into surface 36 with coercive forces 50 primarily extending outwards from face 36. Due to this one sided magnetization process, there is virtually no magnetic force extending in the opposite direction outward of face 40. The number of poles per cm is determined in the design of the magnetizing machine and affect the intensity of the magnetic force and its strength at a distance "d" from face 36. In conventional magnets of 0.3 mm to 0.75 mm thicknesses, the pole spacing is typically 5 poles/cm. In this embodiment of the invention, the pole pitch is preferable between 6 and 10 poles/cm to, thus reduce the distance "d" of its reach. For example, with a pole pitch of 7 poles/cm, the holding force is only 20% of full strength with a 0.30 mm gap, compared to 35% at 4 poles/cm, (Dexter Magnetic Technologies Permanent Magnet Catalogue, publisher and year, pp 29. 2006). In the practise of the present invention, the magnetization is designed to be such that only a minimal amount of, say, less than 20% remains beyond the gap provided by layer 11. The use of the gap provided by the layer 11 prevents card 10 from sticking to metallic surfaces, when not desired.

Figure 5:
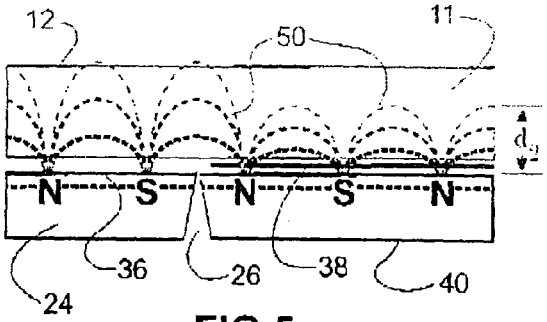

In FIG. 5, a refinement is made in the degree of magnetization across magnetic sheet 32 by adjustments in the operation of the magnetizing machine. In the areas not included in the removable portion 24, the magnetizing force is reduced so that the depth "d" of its reach is reduced to a lesser, distance "$d_2$" which is well within the thickness of layer 11. In this way the total amount of magnetic force in a card 10 may be reduced by approximately 20% to 40%. This facilitates card 10 being processed for reduced postal rates in jurisdictions or countries with more sensitive automated postal sorting machinery or processing rules.

Figure 6:
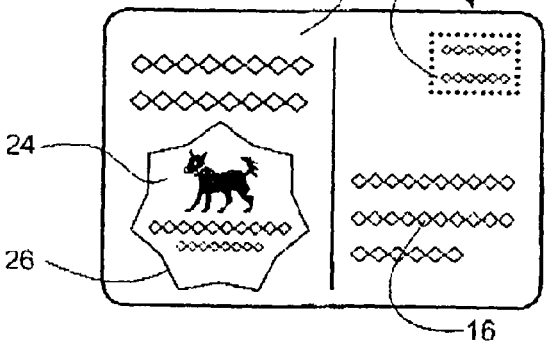
FIG. 6 shows an alternate embodiment of the invention whereby the removable magnetic piece is on the address side of the card.

In an alternative embodiment shown in FIG. 6, indicia 14 and address 16 information are on the same side of card 10 as die cut 26 and, thus, detachable portion 24.

Figure 7:
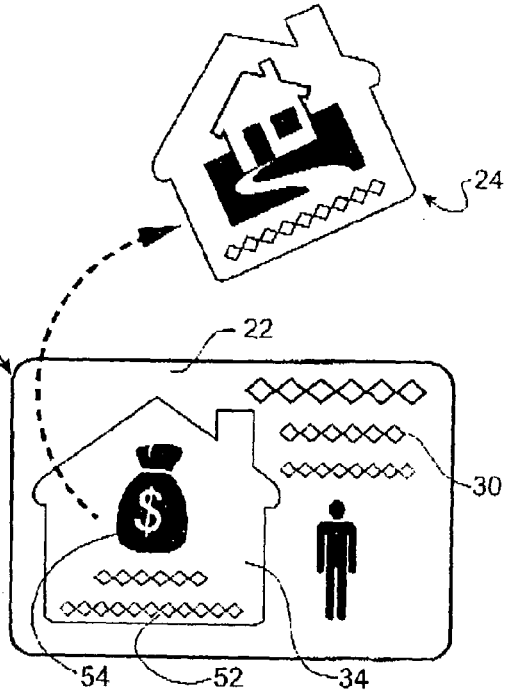
FIG. 7 shows an alternative embodiment of the invention whereby the removable magnetic piece reveals a printed message and/or image underneath.

In FIG. 7, an alternative embodiment is shown which enables an advertiser to include a further incentive for an end-user to remove removable magnetic piece 24. In this optional embodiment, when cardstock 11 is printed, it is printed on both faces 12 and 34 prior to bonding to magnetic face 36 of magnetic layer 32. Thus, when magnetic piece 24 is removed, text 52 and/or images 54 will be revealed. Text 52 and images 54 may represent, for example, a time-limited offer, the image of a new product, or an invitation to visit a website to enter a contest, or to see more details of the advertisers offer to the end-user, or any offer or message as may be invented by advertisers. In the case of this embodiment, the present invention of bonding face 34 to magnetic sheet 32 with permanent adhesive only in the non-removable areas yields a clean advertising message surface with no adhesive residue.

Figure 8:
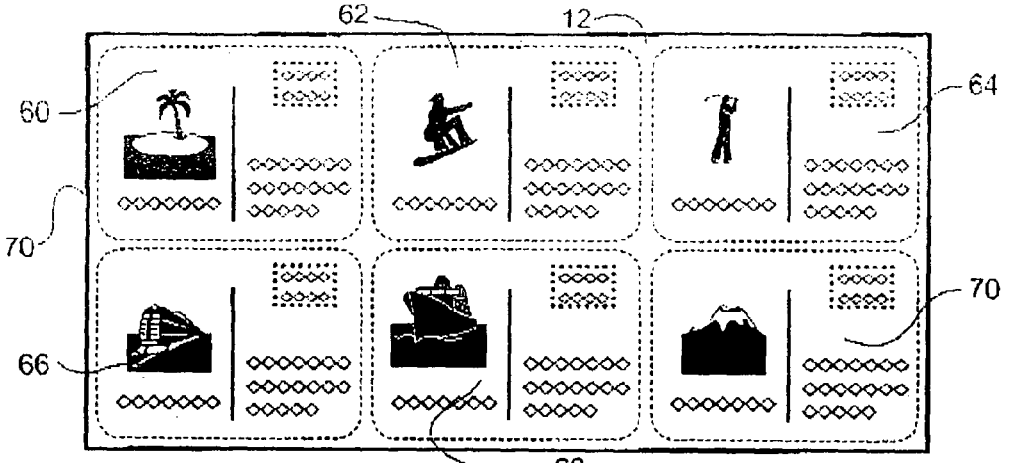
FIGS. 8 and 9 are diagrammatic views of a master sheet with multiple cards and the imposition of variable data on both sides so as to produce a multiple of variable data magnetic advertising cards.
Figure 9:
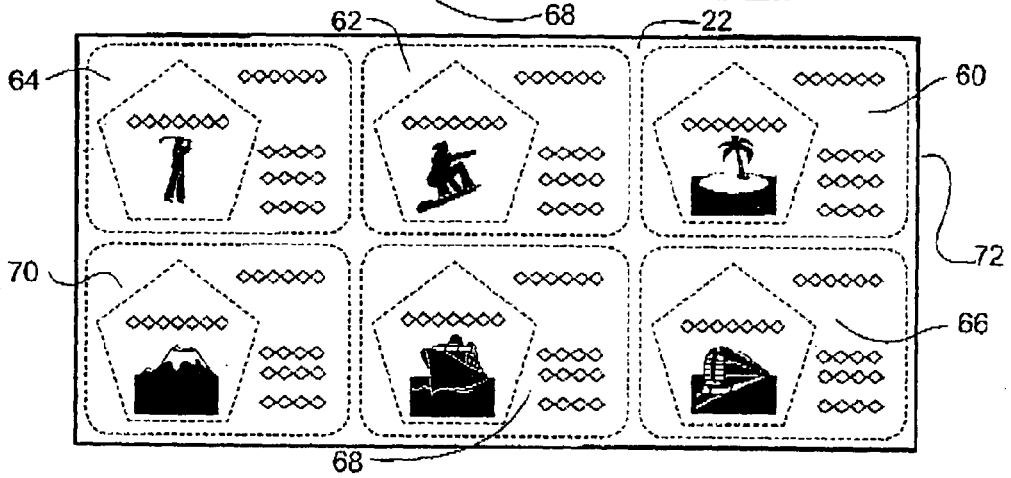
Figure 8A:
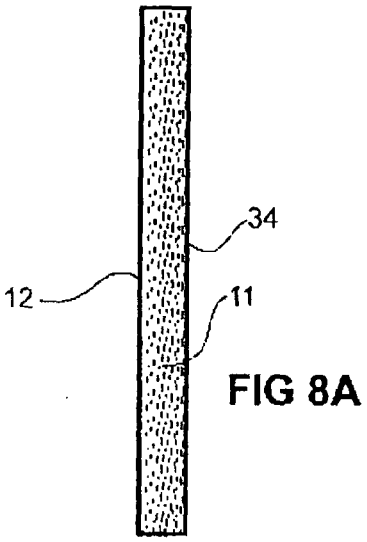
FIGS. 8A and 9A are representative cross sections of the sheets of FIGS. 8 and 9 prior to bonding to each other.
Figure 9A:
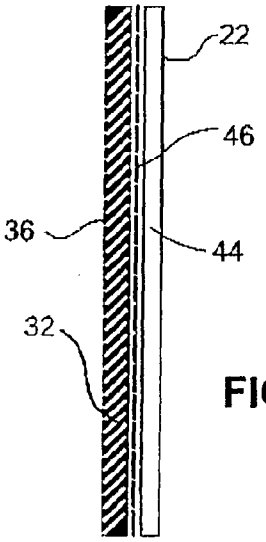

A new and most advantageous of the cards according to this invention is that it allows, for the first time, the use of variable data from a digital press on a magnetic advertising substrate without the necessity of having to die cut the piece separate from the mailing enclosure or card, which, thus, avoids all the sorting and mismatching issues. In FIGS. 8 and 9, the front and back faces of a master sheet are shown. Side sectional views are shown in FIGS. 8A and 9A. To those skilled in the art of digital printing, it is normal to print a multiple number of paper cardstock personalized postcards with variable data software. The following description illustrates how this art can now be applied for the first time to a postcard application containing a removable magnetic portion.

The personalized data such as name, address and variable images for each recipient is simply shown as a number 60, 62, 64, 66, 68 and 70, in this embodiment, wherein each number relates to a separate recipient. As an example, the recipients could be vacation travel prospects and the text and images would not only have their addresses but an offer for a type of vacation that may appeal to them based on past purchases, as illustrated in FIGS. 8 and 9 by various vacation activity icons. These are printed on faces 12 and 22 so that when bonded, a two-sided personalized card is created. Additionally face 34 may also be printed in the same manner to create the hidden message as shown in FIG. 7. The composite sheets of FIGS. 8 and 9 are superimposed back-to-back along edges 70 and 72. Alternative joining of the two sides may be made on any face, depending on the equipment available; and the order of personalizing the full master sheet would be varied to suit.

Figures 10, 10A:
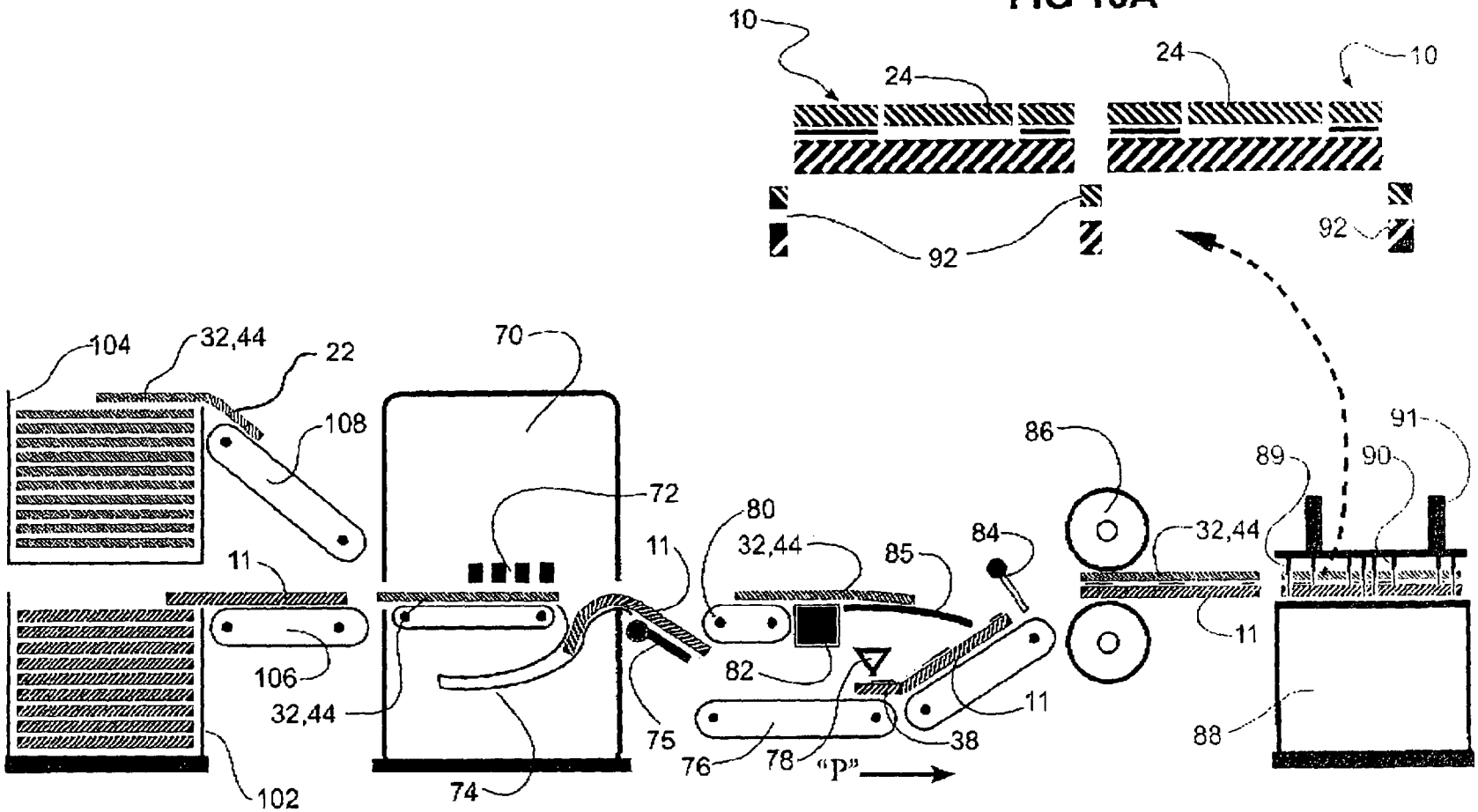
FIG. 10 represents a diagrammatic flow sheet of a sheet-fed digital press printing, bonding and die cutting manufacturing process according to the invention.
FIG. 10A shows an enlarged cross section of the cards as cut from a master sheet.

A practical manufacturing process of producing a card according to the invention is shown in FIG. 10.

Cardstock 11, and magnetic material sheet 32 with its face 22 and printable sheet or coating 44 upwards, each having the same master sheet area dimensions are fed from feed trays 102 and 104, respectively, by conveyers 106 and 108, respectively, to digital printing press 70 in turn. The printing software is programmed such that sheet 11 is fed first and followed by sheet 32 with printable sheet 44, and each is imaged on the top face with the correct layout and location of images through the digital printing heads 72.

Sheet 11 then passes through a duplexer 74 contained in the machine to flip it over so that it exits press 70, with the printed face down. The same duplexer may also be used to image the other side of cardstock 11 if so desired. Such a process may be carried out with the invention in commercial digital printing machines, such as, for example, Konica Minolta C6500® or HP Indigo®.

Upon exiting printing press 70, sheets 11 and 32 with printable sheet 44, are directed towards either an upper or lower conveyor by a paddle 75 which, transfers cardstock 11 to lower conveyor 76 for adhesive pattern application 78, and magnetic sheet 32 with printable sheet 44 to upper conveyor 80 to be magnetized 82. After this, a registration mechanism 84 holds lower sheet 11 in place momentarily, while upper sheet 32 with printable sheet 44 proceeds down ramp 85 and is registered with its leading edge. The two attached sheets are then sent through pressure roller 86 to ensure a solid wrinkle free bond. Subsequently, the bonded composite sheet is placed in die cutter 88 which cuts out card 10 to provide it with its removable magnetic piece 24, of, essentially, the desired shape but leaving sufficient and suitably located minor uncut portions remaining integrally with the remaining magnetic material to hold the detachable portion to card 10. This is accomplished through striking the composite with die assembly 91 in which die knives 90 which cut on the perimeter of the removable portion 24 partially through the composite and by knives 89 which cut through completely and define the size and shape of card 10.

Rather than using a die cutter the individual cards may also be cut from the master sheet by means of a guillotine as well.

In FIG. 10A an enlarged section of the cut sheet is shown with cards 10 removed leaving trim 92, each card 10 containing the removable magnetic piece or pieces 24.

The cards according to the invention may also be produced on a sheet-fed offset ink process press, or ink jet printers instead of the digital press. In addition, the process could be carried out with sheet materials being fed and printed in a roll form, and with magnetic sheet 32 being bonded to a face sheet or being coated with a liquid polymer having a printable surface, in situ rather than being supplied pre-bonded. As well an intermediate polymer film laminating section could apply clear films as shown as layers 29 and/or 35 in FIG. 3. to one or both external faces for appearance reasons.

FIG. 11 shows a form of adhesive application pattern to provide the absence of adhesive in the removable magnet area wherein sheet 11 moves along a belt in the direction "p" passing under adhesive applicators. The adhesive may be commercially available and selected, for example, from thermoplastic polymers e.g. hot melt adhesives, water based emulsions, or solvent based adhesives. The may be applied by roller, spray, nozzle or slot or other means. The curing method may be, for example, ambient air cure, a convective heat tunnel, a radiant heat tunnel, ultraviolet lamp curing or radio frequency curing. Preferred applicators consist of a series of application heads 92 which cycle on and off only at the front and back of the sheet or individual card edges. Intermediate application head 94 are programmed to cycle on and off based on the dimensions of the size and shape of removable magnet area.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. A composite magnetic card for bearing printed data comprising (a) a first planar sheet of paper cardstock having a first face and second face;

(b) a second planar sheet having a magnetic first face and a second face and defining at least one detachable portion defined by a die cut while having suitably located portions integrally retained to non-detachable magnetic material of said second planar sheet;

wherein said first sheet first face is sufficiently and suitably adhered with an adhesive to said second sheet first face to retain said detachable portion of said second sheet to said first sheet but wherein said adhesive is not disposed at first selected locations between said first sheet and said second sheet within said card, such that when the detachable portion is removed, a portion of the first sheet first face that was previously covered by the detachable portion remains with the first planar sheet and is visible, wherein said magnetic first face is of a selected pole configuration and magnetic strength and said first sheet is of a thickness that provides no more than 20% magnetic field outwardly of said first sheet such that when at least a pair of the composite magnetic cards are in stacked relation, the stacked composite magnetic cards can be moved easily with respect to each other.

2. A card as claimed in claim 1 wherein said first sheet first face bears printed designations thereon.

3. A card as claimed in claim 1 wherein said first sheet second face bears printed designations thereon.

4. A card as claimed in claim 1 wherein said second sheet second face bears printed designations thereon.

5. A card as claimed in claim 1 wherein at least one portion of said second sheet is detachable from said first sheet.

6. A card as claimed in claim 1 wherein each of said first and second sheets comprise a laminate with a clear polymer film upon or under which said printed designations are printed.

7. A card as claimed in claim 1 being an advertising postcard.

8. A postcard as claimed in claim 7 wherein said magnetic first face is of a selected pole configuration and magnetic strength and said first sheet is of a thickness that provides essentially zero magnetic field outwardly of said first sheet.

9. A process of making a composite magnetic card comprising:

(a) feeding (i) a sheet of first material having a first printable face and a second printable face and comprising paper cardstock; and (ii) a sheet of a second material having a first printable face and a second face comprising a magnetic material, to a printing press;

(b) printing desired designations on said first material first printable face and on said second material first printable face by said press;

(c) registering said sheet of first material with said sheet of second material in juxtaposition with each of said second faces facing each other;

(d) selectively applying an adhesive to effect adhesive bonding of said sheet of first material to said sheet of second material at said second faces to produce said composite magnetic card but not at first selected locations between said first sheet and said second sheet within said card so that a portion of said sheet of second material may be detached from said sheet of first material enabling a portion of the second face of the first material to be visible, and (e) ensuring that said magnetic second face is of a selected pole configuration and magnetic strength and said sheet of first material is of a thickness that provides no more than 20% magnetic field outwardly of said sheet of first material such that when at least a pair of the composite magnetic cards are in stacked relation, the stacked composite magnetic cards can be moved easily with respect to each other.

10. A process as claimed in claim 9 further comprising cutting an outline on said card through said second material to define a desired shape of a magnetic material portion detachable from said first material.

11. A process as defined in claim 10 comprising cutting a plurality of outlines defining a plurality of desired shapes to produce a plurality of detachable magnetic material portions.

12. A process as defined in claim 9 further comprising printing desired designations on said first material second face.

13. A process as defined in claim 9 further comprising cutting said composite magnetic sheet into a plurality of cards of smaller dimension.

14. A composite magnetic card for bearing printed data comprising:

(a) a first planar sheet of paper cardstock having a first face and second face; and (b) a second planar sheet having a magnetic first face and a second face and defining at least one detachable portion defined by a die cut while having suitably located portions integrally retained to non-detachable magnetic material of said second planar sheet;

wherein said first sheet first face is sufficiently and suitably adhered with an adhesive to said second sheet first face to retain said detachable portion of said second sheet to said first sheet but wherein said adhesive is not disposed at first selected locations between said first sheet and said second sheet within said card, such that when the detachable portion is removed, a portion of the first sheet first face that was previously covered by the detachable portion remains with the first planar sheet and is visible, wherein said magnetic first face is of a selected pole configuration and magnetic strength and said first sheet is of a thickness that provides essentially zero magnetic field outwardly of said first sheet such that when at least a pair of the composite magnetic cards are in stacked relation, the stacked composite magnetic cards can be moved easily with respect to each other.

* * * * *